US005819383A

United States Patent [19]

Jourde et al.

[11] Patent Number: 5,819,383

[45] Date of Patent: Oct. 13, 1998

[54] BRUSH CONVEYOR AND NEEDLING MACHINE EQUIPPED WITH THIS CONVEYOR

[75] Inventors: Bernard Jourde, Elbeuf; Jean-Christophe Laune, La Saussaye; Robert Jean, Amfreville La Campagne, all of France

[73] Assignee: Asselin, Elbeuf, France

[21] Appl. No.: 860,822

[22] PCT Filed: Jan. 12, 1996

[86] PCT No.: PCT/FR96/00051

§ 371 Date: Jul. 10, 1997

§ 102(e) Date: Jul. 10, 1997

[87] PCT Pub. No.: WO96/21762

PCT Pub. Date: Jul. 18, 1996

[30] Foreign Application Priority Data

Jan. 12, 1995 [FR] France ..... 95 00292

[51] Int. Cl.[6] ..... D04H 18/00

[52] U.S. Cl. ..... 28/107; 198/804

[58] Field of Search ..... 28/105, 106, 107, 28/108, 109, 110, 111, 113, 114, 115; 198/793, 803.14, 803.15, 804, 806, 80.01, 807; 112/80.32, 2.2

[56] References Cited

U.S. PATENT DOCUMENTS 3,890,681 6/1975 Fekete et al. ..... 28/107
4,651,393 3/1987 Dilo et al. ..... 28/111
5,117,541 6/1992 Leuchtenmüller ..... 28/115
5,473,802 12/1995 Dilo ..... 28/107

FOREIGN PATENT DOCUMENTS 2217460 9/1974 France ..... 28/107

*Primary Examiner*—C. D. Crowder
*Assistant Examiner*—Larry D. Worrell, Jr.
*Attorney, Agent, or Firm*—Greer, Burns & Crain, Ltd.

[57] ABSTRACT

A brush conveyor, such as a velvet needling machine, has an assembly of contiguous brushes disposed in transverse rows, and a drive source for this assembly of brushes which forms a conveying plane having a predetermined direction of displacement to constitute an upper face of the conveyor. Each brush includes a body including, on its upper face, holes which are provided for receiving a tuft of hair and, on its lower face, connecting apparatus to fasten this brush to a drive source. The drive source has several parallel drive belts or chains placed between at least two drive cylinders running in the same direction. The conveyor also has a support structure for supporting the brush bodies forming the conveying plane. This support structure includes a support table having several flat support parts separated by spaces provided for the drive belts or chains. With each transverse row of brushes a connecting rail, attached to at least one brush in a row, extends along the width of the conveyor, disposed perpendicular to the direction of displacement. The connecting rail is also attached to the drive belts or chains.

17 Claims, 3 Drawing Sheets

FIG_2
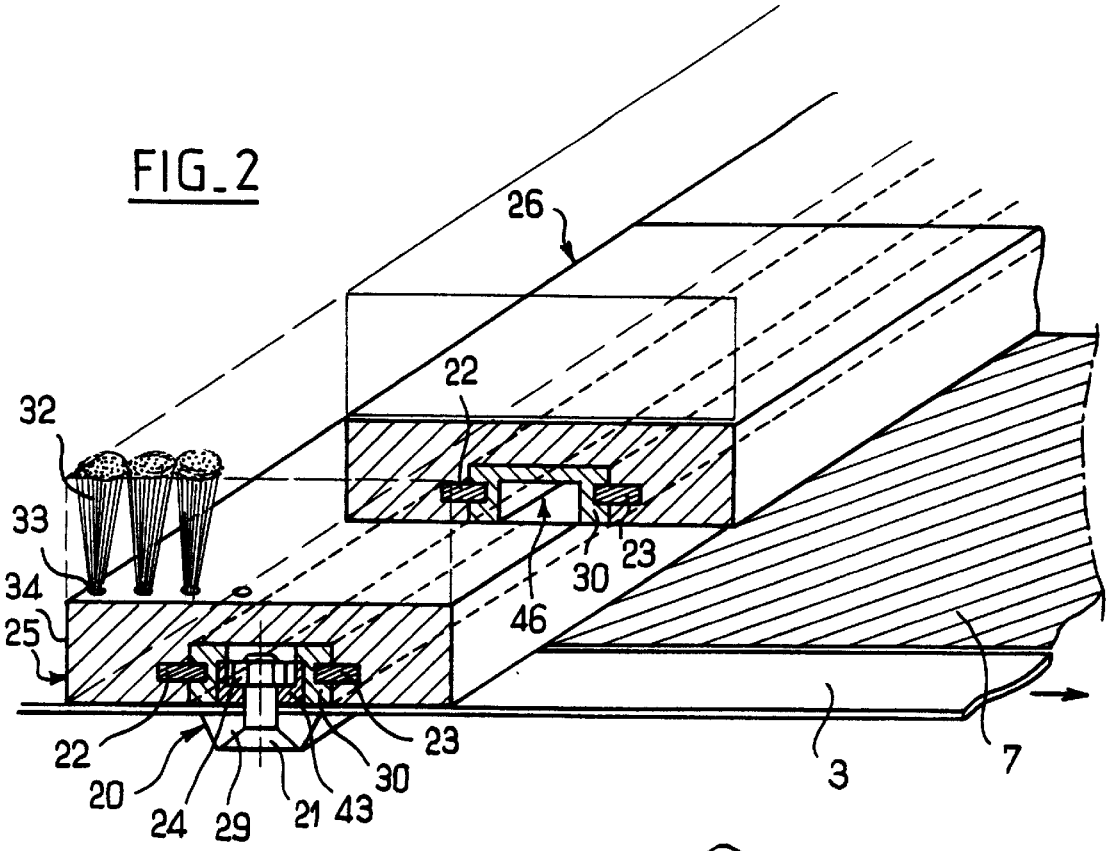
FIG_3
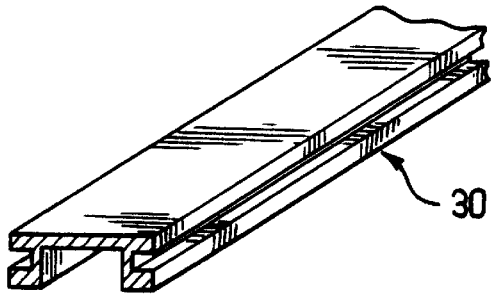
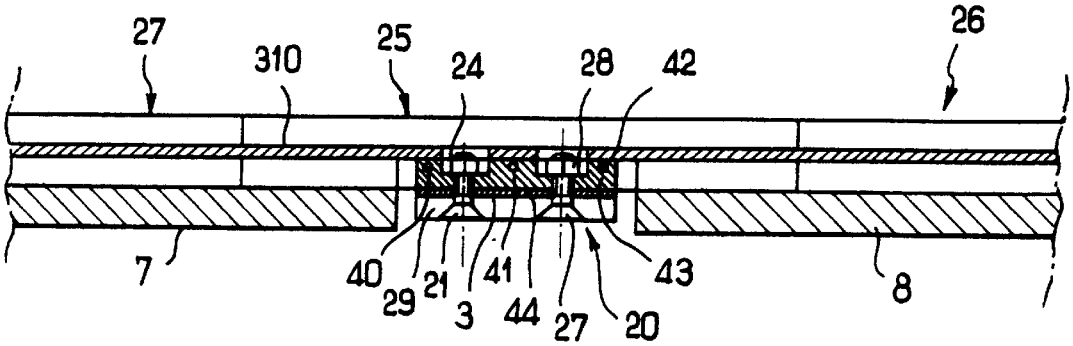
FIG_4

BRUSH CONVEYOR AND NEEDLING MACHINE EQUIPPED WITH THIS CONVEYOR

BACKGROUND

The present invention relates to a brush conveyor. It also relates to a needling machine equipped with this conveyor.

Needling machines of the prior art are equipped with a system for driving cloths of fibers, provided with an assembly of contiguous brushes. The two functions of these brushes are to drive the fibers and to receive these fibers when the needling takes place. They are generally attached to rails disposed transversely to the direction of drive and driven by drive belts or chains.

In systems of the prior art it is observed that the brushes have a double rocking motion, in the vertical direction and in the horizontal direction, while the needling is in progress and then while the stripping is in progress because of the play between the brushes and the rails and the great distance between the axis of the drive chain or belt and the body of the brush. This double motion induces a marking or line-marking in the textile which is prejudicial to the quality of the final product. The document FR-A-2 217 460 reveals a needling machine comprising an endless band provided with bristles which presses, under a needling assembly, onto a horizontally mobile plate providing a support function. This endless band can consist of separate links articulated with each other and whose function is to support the bristles. This configuration is not adapted to needling machines fitted with a conveyor comprising an assembly of contiguous brushes and does not solve the problem actually encountered of a double rocking motion of brushes during needling and stripping.

SUMMARY BY THE INVENTION

The purpose of the invention is to overcome these disadvantages by proposing a brush conveyor for a velvet needling machine which makes it possible to obtain an isotropic product without line-marking.

This purpose is achieved with a brush conveyor comprising an assembly of contiguous brushes disposed in transverse rows, means of driving this assembly of brushes in order to constitute on the upper face of the conveyor a conveying plane for conveying in a predetermined direction of displacement, each brush comprising a body comprising, on its upper face, holes each of which is provided for receiving a tuft of hair and, on its lower face, means of connecting this brush to the drive means, these drive means comprising several parallel drive belts or chains placed between at least two drive cylinders whose direction of drive is common and this conveyor furthermore comprising means of directly supporting the brush bodies constituting the conveying plane.

According to the invention, the support means comprise a support table comprising several flat support parts separated by spaces provided for receiving the drive belts or chains, and with each transverse row of brushes there is associated a connecting rail extending over the entire width of the conveyor, disposed perpendicular to the direction of displacement and attached to the drive belts or chains.

Thus, the play of the brushes is considerably reduced during needling. Furthermore, reducing the distance between the drive means and the brush bodies contributes to reducing the harmful effects caused by the rocking of these brushes. In a conveyor according to the invention, the brush bodies are held transversely with respect to each other by means of the connecting rails and at the same time are supported vertically by a support table.

According to an advantageous embodiment of the invention, the conveyor furthermore comprises means of holding the brushes constituting the conveying plane against the support table in such a way that the lower faces of the bodies of these brushes are held in constant contact with the support parts, which is not at all the case in systems of the prior art.

The holding means can comprise magnetic attraction means, and the lower faces of the brush bodies and the support table comprise parts made of ferromagnetic material.

It is also possible to make provision for the support table to comprise perforations and for the holding means to comprise means of creating a vacuum through the perforations of the support table.

According to another aspect of the invention, there is proposed a velvet needling machine comprising a brush conveyor according to one of the preceding claims and means of needling a cloth of fibers supported and driven by the conveyor, these needling means cooperating with the brushes of the conveyor in order to drive fibers from the cloth into the tufts of hair of these brushes.

Other features and advantages of the invention will furthermore appear in the following description. In the accompanying drawings given as non-limitative examples:

FIG. 2 shows an example of assembling brushes used in a needling machine according to the invention;

FIG. 3 shows an example of a rail used for assembling the brushes;

FIG. 4 is a partial cross-sectional view of a transverse row of brushes illustrating a particular method of fixing a brush to a drive belt in a needling machine according to the invention;

DETAILED DESCRIPTION

Figure 1:
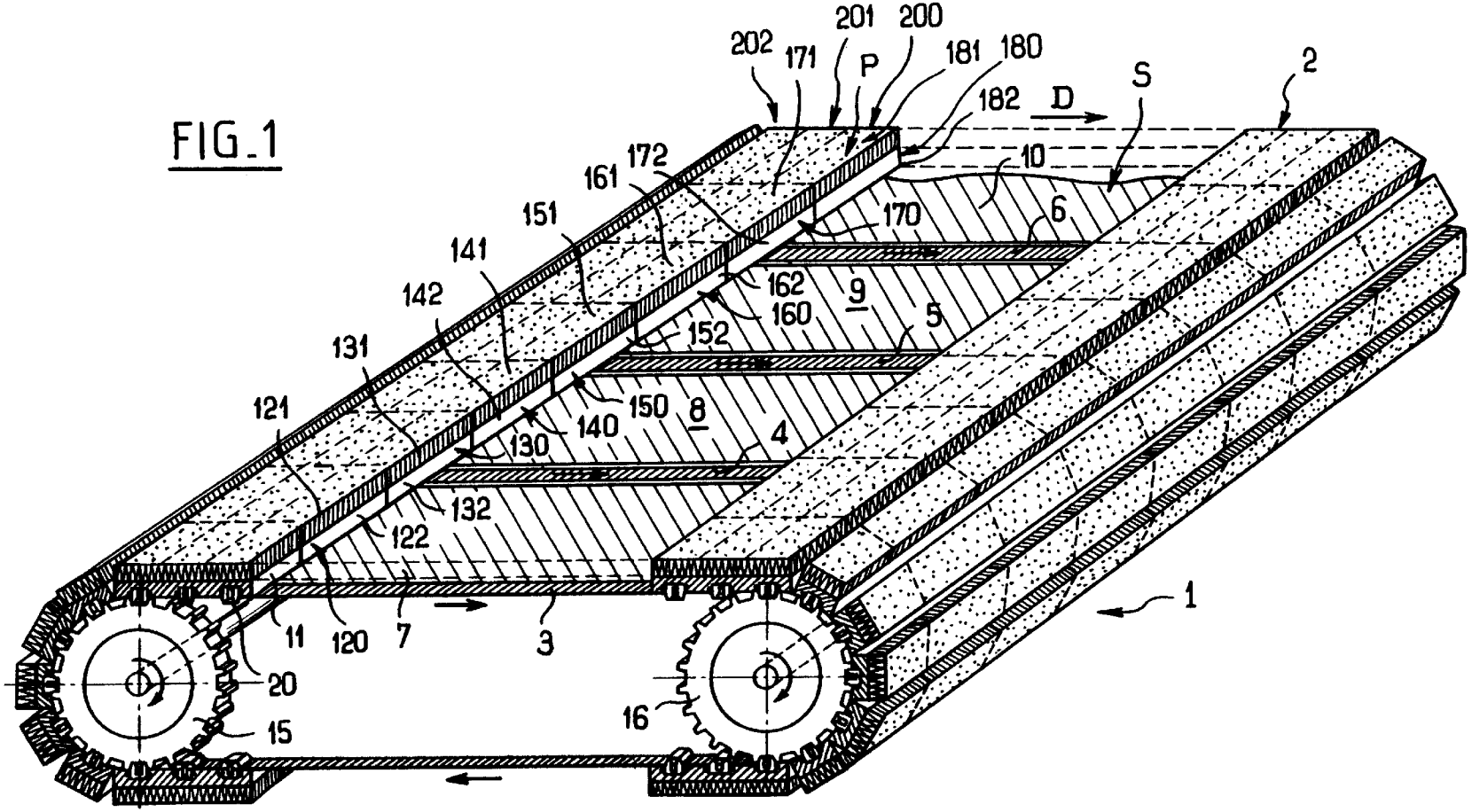
FIG. 1 is an exploded perspective view of a brush conveyor fitted to a needling machine according to the invention.

An embodiment of a brush conveyor according to the present invention will now be described with reference to FIGS. 1 to 4.

A brush conveyor 1 comprises a drive device comprising, for example, two drive cylinders 15, 16 around which are placed belts 3–6 or any other equivalent means such as chains. The movement of these belts defines a direction of displacement D and the upper plane space existing between the cylinders 15, 16 constitutes a conveying plane D whose function is to support and drive a cloth of fibers during the needling operation. This conveying plane includes an assembly 2 of brushes 120, 130, 140, 150, 160, 170, 180 disposed in transverse rows 200, 201, 202, perpendicular to the direction of displacement D. When a transverse row of brushes leaves the conveying plane P, it then describes a first circular trajectory around a cylinder 16, then a straight trajectory between the two cylinders, and another, second circular trajectory around the other cylinder in order finally to rejoin the conveying plane P in which the brushes are tightly contiguous in order to limit the appearance of marking defects in the needled product. When they are in the conveying plane P, the brushes 120, 130, 140, 150, 160, 170, 180 have their bodies 122, 132, 142, 152, 162, 172, 182 in direct contact with a support table S which is substantially flat and horizontal, and the tufts of hair 121, 131, 141, 151, 161, 171, 181, 32 (in FIG. 2) regularly implanted in receiving holes 33 on the upper faces of the brushes form a homogeneous and isotropic assembly in which the needles penetrate with an alternating motion.

The support table S in practice consists of several support parts 7, 8, 9, 10 separated by spaces or interstices extending parallel with the direction of displacement D and provided for receiving the drive belts 3, 4, 5, 6 which in practice are flush with the support parts. Within a same transverse row 200, 201, 202, the bodies 122, 132, 142, 152, 162, 172, 182 of the brushes are integrated by a connecting rail 30 (FIG. 2) which is common to all of the brushes and is itself attached to the drive belts by attachment devices 20.

An example of connecting a row of brushes to the drive device of a conveyor according to the invention will now be described in greater detail with reference to FIGS. 2 to 4. The brushes 25, 26, 27 of this conveyor each comprise a recess formed in their lower face and forming a slide, extending longitudinally in the principal axis of each brush and designed to receive a connecting rail 30 having, in practice, a structure of the profiled type. When a row of brushes 27, 25, 26 is formed by inserting the connecting rail 30 in the respective recesses, keys 22, 23 are then inserted, by force or otherwise, into appropriate housings in the recesses in order to hold and integrate all of the brush bodies in a row. The brushes 25 which are above a separating space between two support parts 7, 8 comprise at the level of their lower face a device 20 for attaching the brush body-connecting rail assembly to the drive belt 3 located in the separating space in question. This separating space preferably has a width substantially less than the length of a brush so that the brushes 25 located above the separating space nevertheless have on their lower faces sufficient contact areas with the support parts 7. The brushes 26 which are not located above a separating space have their entire lower face in contact with the corresponding support part 7.

Each attachment device 20 has a length substantially equal to the width of a belt 3, with reference to FIGS. 2 and 4, so that it does not hinder the movement of this belt inside the separating space. It comprises a part 43 inserted in a free space inside the connecting rail 30 and rendered integral with the latter by three transverse rods 40, 41, 42. This part 43 is designed to receive two nuts 24, 28 corresponding to two screws 21, 27 which clamp the belt 3 between, on the one hand, a tooth 29 of the belt pierced with two holes for the passage of the screws and placed under the belt 3 and, on the other hand, the lower face of the connecting rail 30. This attachment device 20 thus makes it possible to attach the connecting rail 30 to the belt 3. The other brushes are also driven because of the mechanical connection of the brushes in a same transverse row which is procured by the presence of the connecting rail. With this attachment method, the lower faces of the brush bodies 27, 25, 26 can be in direct contact with the support parts 7, 8, which contributes to a substantial improvement in the stability of these brushes during needling.

The rocking effects of the brushes can furthermore be considerably reduced by using an active holding of the brush bodies against the support table, as shown in FIGS. 5A, 5B, 5C and 6.

A first embodiment of this holding consists in using the well known effects of magnetic attraction. It is possible, for example, with reference to FIG. 5A, to provide on the lower face of the body 51 of each brush rendered integral with a connecting rail 30 by keys 57/1, 57/2, permanent magnets 52, 53 made of ferrite or rare earth materials such as Samarium-Cobalt or Iron-Neodymium-Boron and to use a support table 55 made of a ferromagnetic material. The magnetic attraction effects between the magnets and the ferromagnetic table will generate attraction forces in a direction substantially normal to the plane of the support table. It is also possible to make provisions for placing permanent magnets on the support table, for example in the form of tapes or strips or in any other form, and to make the brush bodies from a ferromagnetic material.

Figure 5A:
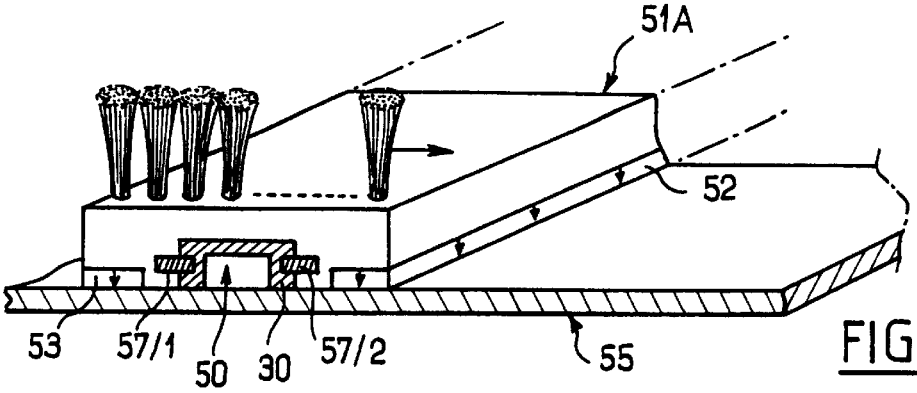
FIG. 5A shows a first method of holding brushes against a support table, using permanent magnets disposed in the brushes.
Figure 5B:
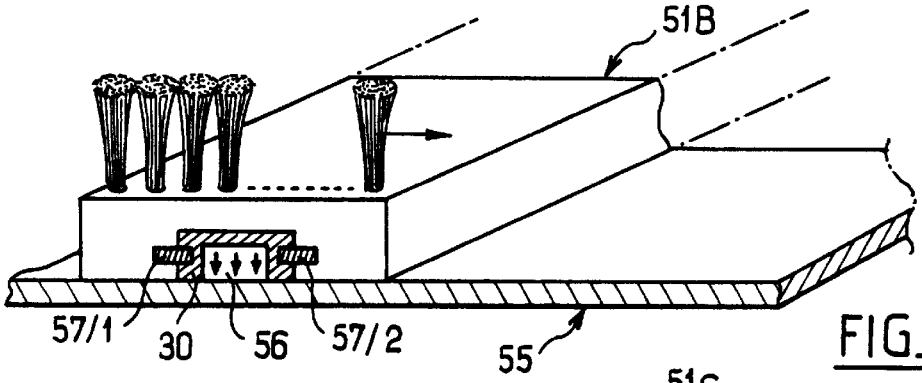
FIG. 5B shows a second method of holding, using permanent magnets disposed in the connecting rail and keys of rectangular cross-section.

In a second embodiment shown in FIG. 5B, permanent magnets 56 are disposed in the internal space 50 of the connecting rail 30, the support table 55 still being made of a ferromagnetic material.

Figure 5C:
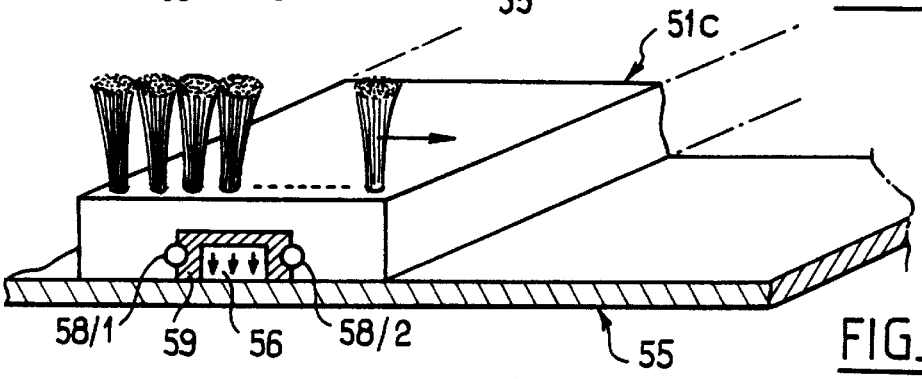
FIG. 5C shows a third method of holding using magnets disposed in the connecting rail and keys of circular cross-section.

In a third embodiment shown in FIG. 5C, magnets 56 are also disposed inside the connecting rail 59, the latter and the brush bodies being designed to receive keys 58/1, 58/2 having a circular cross-section. This embodiment has the advantage of an automatic taking up of lateral play.

Figure 6:
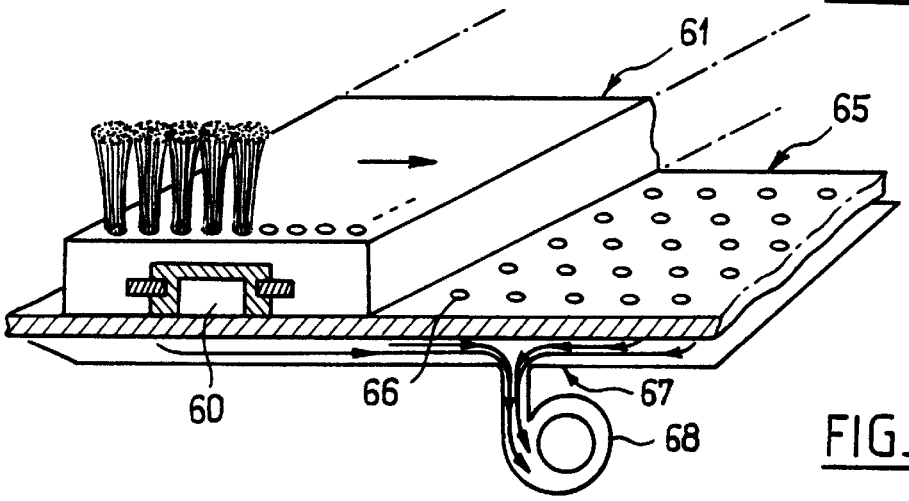
FIG. 6 shows a fourth method of holding the brushes against a support table, using a vacuum system.

A fourth embodiment of active holding of the brushes against the support table consists in using attraction by vacuum, as shown in FIG. 6. A vacuum generating device 67 comprises suction equipment 68 disposed under a support table 65 provided with perforations 66. A vacuum is thus created at the surface of the support table 65. This vacuum must be adjusted to ensure a correct holding of the brush bodies 61 during needling operations.

In each of the embodiments mentioned above, the holding means 52, 53; 67 cooperate with the connecting means 50; 60 to provide the greatest stability to the brush bodies when they are simultaneously subjected to the driving forces transmitted by the belts and by the connecting rails and to the alternating needling forces. It is also possible to combine several separate techniques for holding the brushes against the support table.

The brush conveyor 1 which has just been described can be used advantageously in a velvet needling machine but it can also be used in other industrial equipment requiring a conveying surface having a brush-like surface state.

The invention is not of course limited to the example embodiments which have just been described and numerous modifications can be applied to these examples without departing from the scope of the invention. Thus it is possible to have numerous other arrangements for the embodiment of the holding means. In particular, the optimum arrangement of the permanent magnets can be determined according to electromagnetic calculations. Furthermore, it is possible to provide multiple variants for the method of attaching the brush bodies to the drive belts or chains. Furthermore, the shape of the brushes, the density of the hairs, the arrangement of the brushes in the conveying plane and their method of assembly do not constitute limitations to the scope of the present invention.

We claim:

1. A brush conveyor, comprising: an assembly of contiguous brushes disposed in transverse rows, means of driving this assembly of brushes in order to constitute on an upper face of the conveyor a conveying plane having a predetermined direction of displacement, each brush comprising a body comprising, on its upper face, holes each of which is provided for receiving a tuft of hair and, on its lower face, means for connecting this brush to drive means, said drive means comprising several parallel drive belts or chains placed between at least two drive cylinders whose direction of drive is common, and said conveyor furthermore comprising means for directly supporting the brush bodies constituting the conveying plane, said support means comprise a support table comprising several flat support parts separated by spaces provided for receiving the drive belts or chains, and in that with each transverse row of brushes there is a connecting rail attached to at least one of said brushes in said row, said connecting rail extending along the width of the conveyor, disposed perpendicular to the direction of displacement and attached to the drive belts or chains.

2. The brush conveyor according to claim 1, characterized in that each brush body comprises, as a means of connection, a recess over its entire length provided for receiving the connecting rail and means for locking the connection, this recess and this connecting rail being designed to ensure direct contact of lower faces of the bodies on the support parts.

3. The brush conveyor according to claim 2, characterized in that the connection means furthermore comprise, for each rail, means for attaching said rail to each drive belt or chain, said means being partially engaged in the recesses of the bodies of the brushes located above each belt or chain.

4. The brush conveyor according to claim 2, characterized in that the connecting rails associated with each transverse row of brushes have a structure including a cross section having a generally main C-channel shape having a pair of depending legs, each said leg defining a keyway.

5. The brush conveyor according to claim 2, characterized in that it furthermore comprises means for holding the brushes constituting the conveying plane against the support table in such a way that the lower faces of the bodies of said brushes are held in constant contact with the support parts.

6. The brush conveyor according to claim 5, characterized in that the holding means comprise magnetic attraction means and in that the lower faces of the bodies of the brushes and the support table comprise parts made of ferromagnetic material.

7. The brush conveyor according to claim 6, characterized in that the magnetic attraction means comprise permanent magnets.

8. The brush conveyor according to claim 7, characterized in that the permanent magnets are located on the lower faces of the bodies of the brushes.

9. The brush conveyor according to claim 7, characterized in that the permanent magnets are located on the support table.

10. The brush conveyor according to claim 7, characterized in that the permanent magnets are disposed on the connecting rail.

11. The brush conveyor according to claim 5, characterized in that the support table comprises perforations and in that the holding means comprise means for creating a vacuum through the perforations of the support table.

12. The brush conveyor according to claim 5, characterized in that the connection locking means comprise keys of substantially rectangular cross-section, and in that the connecting rail and the brush bodies are configured to receive said keys.

13. The brush conveyor according to claim 5, characterized in that the connection locking means comprise keys of substantially circular cross-section, and in that the connecting rail and the brush bodies are configured to receive said keys.

14. A velvet needling machine comprising a brush conveyor of contiguous brushes disposed in transverse rows, means of driving this assembly of brushes in order to constitute on an upper face of the conveyor a conveying plane having a predetermined direction of displacement, each brush comprising a body comprising, on its upper face, holes each of which is provided for receiving a tuft of hair and, on its lower face, means for connecting this brush to drive means, said drive means comprising several parallel drive belts or chains between at least two drive cylinders whose direction of drive is common, and said conveyor furthermore comprising means for directly supporting the brush bodies constituting the conveying plane, these support means comprise a support table comprising several flat support parts separated by spaces provided for receiving the drive belts or chains, and in that with each transverse row of brushes there is a connecting rail attached to at least one of said brushes, the connecting rail extending along the width of the conveyor, disposed perpendicular to the direction of displacement and attached to the drive belts or chains, means for needling a cloth of fibers supported and driven by the conveyor, said needling means cooperating with the brushes of the conveyor in order to drive fibers from the cloth into the tufts of hair of said brushes.

15. The brush conveyor according to claim 1, characterized in that each said connecting rail extends over the entire width of the conveyor.

16. The brush conveyor according to claim 3, characterized in that it furthermore comprises means for holding the brushes constituting the conveying plane against the support table in such a way that the lower faces of the bodies of said brushes are held in constant contact with the support parts.

17. The brush conveyor according to claim 4, characterized in that it furthermore comprises means for holding the brushes constituting the conveying plane against the support table in such a way that the lower faces of the bodies of said brushes are held in constant contact with the support parts.

* * * * *